US006012419A

United States Patent [19]

Iwasaki et al.

[11] Patent Number: 6,012,419

[45] Date of Patent: Jan. 11, 2000

[54] ROTATIONAL PHASE ADJUSTING APPARATUS HAVING SEAT FOR DRILL-MACHINING

[75] Inventors: Kazutoshi Iwasaki, Nagoya; Yoshio Matsumoto, Inabe-gun, both of Japan

[73] Assignee: Denso Corporation, Japan

[21] Appl. No.: 08/907,482

[22] Filed: Aug. 8, 1997

[30] Foreign Application Priority Data

Aug. 9, 1996 [JP] Japan ..... 8-211432

[51] Int. Cl.[7] ..... F01L 1/34

[52] U.S. Cl. ..... 123/90.17; 29/888.01; 464/2

[58] Field of Search ..... 123/90.15, 90.17; 464/2; 29/888.01

[56] References Cited

U.S. PATENT DOCUMENTS 5,107,804 4/1992 Becker et al. .
5,666,914 9/1997 Ushida et al. ..... 123/90.17

FOREIGN PATENT DOCUMENTS 2-50105 U 4/1990 Japan .
6-712 6/1992 Japan .

*Primary Examiner*—Noah P. Kamen
*Attorney, Agent, or Firm*—Nixon & Vanderhye PC

[57] ABSTRACT

In a rotational phase adjusting apparatus used for adjusting opening/closing timings of an intake valve or an exhaust valve of an internal combustion engine, a shoe housing driven by a driving shaft has a circumferential wall and a front plate which are integrally formed by aluminum die-casting. Each shoe has a distortion-absorbing hole, and a fan-shaped chamber for accommodating a vane for driving a driven shaft is formed between adjacent two of the shoes. The outer circumferential wall of each shoe has a recess which has an arch shape in section and extends in an axial direction. A clamp seat is formed on a front plate side. When the clamp seat is pressed by a draw claw, a portion of each shoe on the outer circumferential side of the distortion-absorbing hole is resiliently deformed, but a portion of each shoe on the inner circumferential side of the distortion-absorbing hole is deformed less. Thus, this improves the machining accuracy of working surfaces of the shoe housing which affects on sealability and sliding wear between component parts.

18 Claims, 8 Drawing Sheets

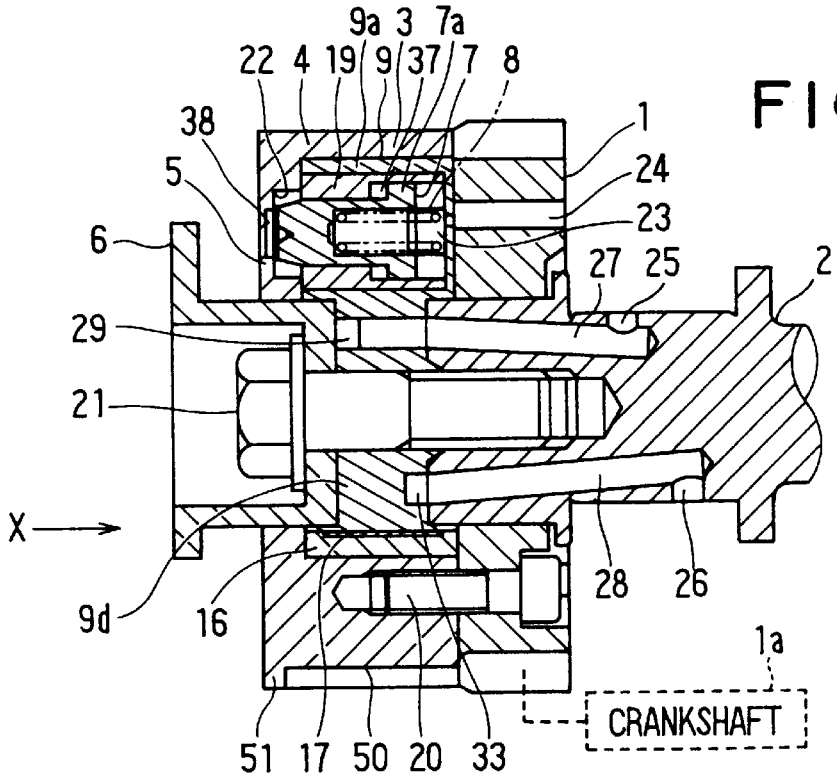
FIG. 1
FIG. 2
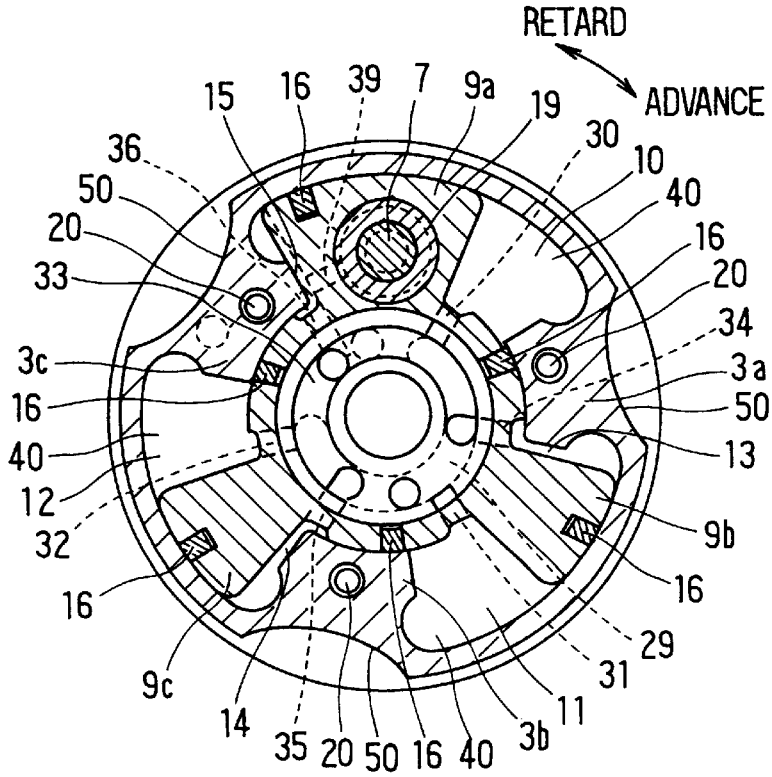

ROTATIONAL PHASE ADJUSTING APPARATUS HAVING SEAT FOR DRILL-MACHINING

BACKGROUND OF THE INVENTION

1. Field of the Invention

The present invention relates to a rotational phase adjusting apparatus for adjusting opening/closing timings (a valve timing) of intake valves and exhaust valves of an internal combustion engine (an engine) in accordance with engine operating conditions.

2. Related Art

As a conventional valve timing adjusting apparatus for adjusting valve timing of intake valves and exhaust valves of an engine, a vane-type driving force transmitting member which transmits a driving force from a crankshaft as a driving shaft of the engine to a camshaft as a driven shaft is known. The vanes are accommodated relatively turnably within a housing, and the phase difference of the vanes against the housing is controlled by fluid pressure of operating fluid or the like. It is considered that the housing has a construction wherein a circumferential wall is integrally formed with one side wall so that possibility of leakage of the operating fluid from a fluid pressure chamber is reduced and assembling work is simplified.

The housing having the circumferential wall integrally formed with one side wall requires machining accuracy of an inside surface, an inner circumferential surface, and an opening end surface opposite to the integrally-formed side wall especially in the following points (1), (2) and (3).

(1) Inside surface, inside circumferential surface: sealability among the fluid pressure chambers (2) opening end surface: leakage of the operating fluid to the outside of the housing (3) Depth from the opening end surface to the inside surface: sealability due to clearance with a vane, and scoring and uneven wear due to sliding with the vane The housing is required to be machined with high accuracy: for example, surface roughness to within 3.2 to 6.3 z, depth accuracy to 20 $\mu$m, squareness between the inner circumferential surface and the inside surface to 10 $\mu$m, and flatness of the opening end surface and the inside surface to 20 $\mu$m. To achieve the machining with high accuracy, it is necessary to machine working surfaces of the housing, i.e., the inside surface, the inner circumferential surface and the opening end surface opposite to the integrally-formed side wall by clamping without reclamping, and to suppress deformation due to clamping as least as possible.

A general clamping method by which the peripheral wall of the housing is pressed inward radially makes it possible to cut above-described all working surfaces by clamping without reclamping; however, this causes large deformations of the housing if a hollow member with a thin-walled portion like a vane-type housing is pressed inward radially.

As shown in FIGS. 16 and 17, it is considered that clamp seats 122 and 132 are provided in housing 120 and 130 respectively, and the housing 120 and 130 are axially pressed by a clamp 125 in contact with the clamp seats 122 and 132. When using this clamping method, opening end surfaces 121*a*, 131*a*, inner circumferential surfaces 121*b*, 131*b* and inside surfaces 123, 133 can be machined by clamping without reclamping. In case where the clamp seats 122 and 132 are provided in the outer periphery of thin circumferential walls 121 and 131 respectively and are pressed, resilient deformations of the housings 120 and 130 due to pressure become large as shown with chain double-dashed lines in FIGS. 16 and 17. Though the deformation is recovered by removing the clamp 125 after machining, the flatness of the opening end surfaces 121*a* and 131*a*, the squareness between the inner circumferential surface 121*a* and the inside surface 123, and that between the inner circumferential surface 131*a* and the inside surface 133 are degraded.

As in a method of machining a revolving scroll disclosed in JP-A 6-712, a peripheral groove and a radial groove may be formed in the outer peripheral wall of an end plate so that deformation when clamping is reduced. In the case of the vane-type housing, however, the housing stiffness is decreased if the peripheral groove is formed because a part of the outer peripheral wall does not protrude outward radially unlike the end plate. Though wall thickness may be increased or a ring-shaped jaw portion for forming the peripheral groove may be formed, this increases the size of an apparatus. Furthermore, this causes a problem of complicated machining of the peripheral groove and the radial groove.

SUMMARY OF THE INVENTION

The present invention is made in view of the above problems, and has an object of providing a rotational phase adjusting apparatus with a simple construction which enables machining with high accuracy.

According to the present invention, an outer circumferential surface of a partition dividing accommodating chambers is provided with a seat portion to make contact with a pressing member which axially presses a housing while machining. The deformation of the seat portion and the outer periphery of the partition caused by pressing the pressing member becomes small on the inner circumferential surface of the partition which is thick in the radial direction. Thus, this improves the machining accuracy of working surface of the housing which affects sealability and the sliding wear among component parts. Further, the number of contact portions of the component parts is reduced, thereby improving sealability and making assembly easy.

Preferably, the thickness of the seat portion is made smaller to reduce deformations of the seat portion. This leads to small deformations of a whole housing.

Preferably, a deformation-absorbing hole is provided between the inner circumferential surface of the housing to be machined and the seat portion so that deformation of the portion of the partition which is on the inner circumferential side of the deformation-absorbing hole becomes even smaller than that of the portion of the partition which is on the outer circumferential side of the deformation-absorbing hole. Thus, this improves the machining accuracy of working surfaces of the housing which affects sealability and the sliding wear among component parts.

Preferably, the circumferential wall and one side wall of the housing are integrally formed by aluminum die-casting, thus allowing the housing to be machined easily and reducing the housing in weight.

According to the present invention, further, the seat portion axially opposite to the housing is formed outside the housing and is located at a radially outer position of the partition so that the seat portion can be clamped from the axial direction of the housing and it is possible to reduce distortion of the housing caused by machining the inside of the housing.

Preferably, an attachment hole for attaching a bolt is formed in the partition and the seat portion is located at a radially outer position of the attachment hole. The distortion caused in the housing can be reduced by the attachment hole.

Preferably, the seat portion is formed on one end side of the housing and faces the opposite axial end side in the axial direction so that inclination of the circumferential wall of the housing can be reduced when clamping the housing from the axial direction. In case where the housing has a side wall integrally formed with the circumferential wall, the seat portion is formed in the end portion where the integrated side wall is formed in order to machine the inside of the housing.

Preferably, the seat portion may be formed on one end side of the housing in the axial direction, and also may be formed so as to face the end side.

BRIEF DESCRIPTION OF THE DRAWINGS

In the accompanying drawings;

FIG. 1 is a side sectional view of a rotational phase adjusting apparatus according to a first embodiment of the present invention;

FIG. 2 is a front sectional view of the first embodiment shown in FIG. 1;

DETAILED DESCRIPTION OF THE PREFERRED EMBODIMENT

Figure 3A:
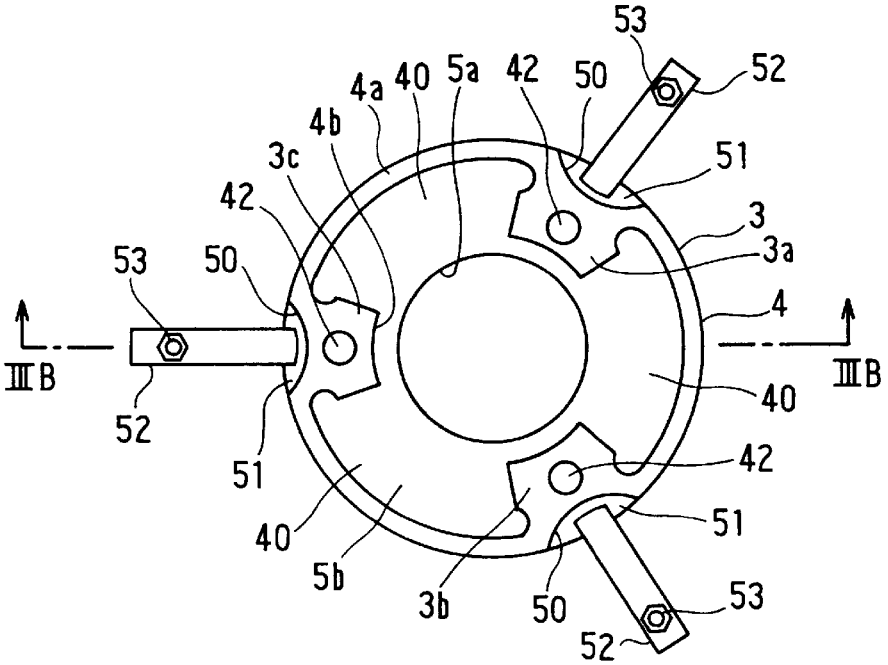
FIGS. 3A and 3B are schematic plan view and cross-sectional view respectively showing a state when clamping a shoe housing according to the first embodiment.

A rotational phase adjusting apparatus according to the present invention will be described with reference to various embodiments which are used for adjusting opening/closing timings of the intake or exhaust valve of an engine.

(First Embodiment)

As shown in FIGS. 1 and 2, a timing gear 1 is provided to receive a driving force from a crankshaft 1*a* as a driving shaft of an engine through a gear train (not shown) for synchronous rotation with the crankshaft 1*a*. A camshaft 2 as a driven shaft is provided to receive a driving force from the timing gear 1 to drive either or both of intake valves and exhaust valves (not shown). The camshaft 2 is held turnably with a predetermined rotational phase difference relative to the timing gear 1. The timing gear 1 and the camshaft 2 are rotatable in the clockwise direction when viewed in the direction X in FIG. 1. This clockwise direction corresponds to an advance direction. The timing gear 1 and a shoe housing 3 are coaxially fixed by bolts 20 to constitute a housing as a driving-side rotation body.

The shoe housing 3 as the housing is formed such that a circumferential wall 4 and a front plate 5 as one side wall are integrally formed. The shoe housing 3 has trapezoidal shoes 3*a*, 3*b* and 3*c* as portions arranged circumferentially and generally equally spaced. Fan-shaped chambers 40 are provided as accommodating chambers for vanes 9*a*, 9*b* and 9*c* as vanes at three circumferential locations where spacing are provided between adjacent two of the shoes 3*a*, 3*b* and 3*c*. The inner circumferential surfaces of the shoes 3*a*, 3*b* and 3*c* are formed arcuately in section.

The outer circumferential wall of each of the shoes 3*a*, 3*b* and 3*c* has a recess 50 extending axially and having an arch shape in section, and a clamp seat 51 as a seat portion is formed in the front plate side.

A vane rotor 9 as a vane has the vanes 9*a*, 9*b* and 9*c* arranged circumferentially at generally equal intervals and accommodated turnably within the corresponding fan-shaped chambers formed circumferentially between the adjacent two of the shoes 3*a*, 3*b* and 3*c*. The vane rotor 9 and a bushing 6 are fixed integrally with the camshaft 2 by a bolt 21 to provide a driven-side rotation body. The bushing 6 fixed integrally with the vane rotor 9 is fitted into the inside wall of the front plate 5 relatively turnably against the front plate 5. Small clearances are provided between the outer circumferential walls of the vane rotor 9 and the inner circumferential walls of the shoe housing 3 so that the vane rotor 9 and the shoe housing 3 are held relatively turnably. Seals 16 are fitted in the outer circumferential walls of the vanes 9*a*, 9*b* and 9*c* and in the outer circumferential walls of a boss 9*d* of the vane rotor 9 and are biased by respective springs 17 to restrict leakage of the operating fluid between fluid pressure chambers.

Retarding-side fluid pressure chambers 10, 11 and 12 are defined between the shoe 3*a* and the vane 9*a*, between the shoe 3*b* and the vane 9*b* and between the shoe 3*c* and the vane 9*c* respectively. Advancing-side fluid pressure chambers 13, 14 and 15 are defined between the shoe 3*a* and the vane 9*b*, between the shoe 3*b* and the vane 9*c* and between the shoe 3*c* and the vane 9*a* respectively.

According to the above construction, the camshaft 2 and the vane rotor 9 are enabled to turn coaxially and relatively against the timing gear 1 and the shoe housing 3.

A guide ring 19 is pressed to fit in the inner wall of the vane 9*a* having an accommodating hole 23, and a stopper piston 7 is inserted into the guide ring 19. The stopper piston 7 is thus accommodated within the vane 9*a* slidably in the axial direction of the camshaft 2 while being biased toward the front plate 5 by a spring 8. The stopper piston 7 receiving the biasing force of the spring 8 is movable into a stopper hole 22 formed in the front plate 5. A communication passage 24 formed in the timing gear 1 is in communication with the accommodating hole 23 at the right side of a flange 7*a* and open to the atmosphere so that the stopper piston 7 is not restricted from moving axially.

A fluid pressure chamber 37 at the left side of the flange 7*a* is in communication with the retarding-side fluid pressure chamber 10 through a fluid passage (not shown). With the operating fluid being supplied into the retarding-side fluid pressure chamber 10, the stopper piston 7 moves out from the stopper hole 22 against the biasing force of the spring 8. A fluid pressure chamber 38 formed at the top side of the stopper piston 7 is in communication with the advancing-side fluid pressure chamber 15 through a fluid passage 39 shown in FIG. 2. With the operating fluid being supplied into the advancing-side fluid pressure chamber 15, the stopper piston 7 moves out from the stopper 22 against the biasing force of the spring 8.

The positions of the stopper piston 7 and the stopper hole 22 are so determined that the stopper piston 7 is fitted into the stopper hole 22 when the camshaft 2 is at the most retarded position against the crankshaft l*a*, that is, when the vane rotor 9 is at the most retarded position against the shoe housing 3. Thus, the stopper piston 7 and stopper 22 provide a lock mechanism.

The boss 9*d* of the vane rotor 9 has a fluid passage 29 at a position where it abuts axial end of the bushing 6 and a fluid passage 33 at a position where it abuts the axial end of the camshaft 2. The fluid passages 29 and 33 are formed arcuately. The fluid passage 29 is in communication with a fluid source or drain (not shown) as a driving means through the fluid passages 25 and 27. Further, the fluid passage 29 is in communication with the retarding-side fluid pressure chambers 10, 11 and 12 through the fluid passage 30, 31 and 32 and in communication with the fluid pressure chamber 37 through a fluid passage (not shown).

The fluid passage 33 is in communication with the fluid source or drain (not shown) through fluid passages 26 and 28. Further, the fluid passage 33 is in communication with the advancing-side fluid pressure chambers 13, 14 and 15 through the fluid passage 34, 35 and 36 and in communication with the fluid pressure chamber 38 through the advancing-side fluid pressure chamber 15 and a fluid passage 39.

The rotational phase adjusting apparatus operates as follows.

When an engine is normally operated, the stopper piston 7 moves out from the stopper hole 22 because of the fluid pressure of the operating fluid supplied to the retarding-side fluid pressure chambers 10, 11, 12 and the advancing-side fluid pressure chambers 13, 14, 15, so that the vane rotor 9 is held relatively turnably against the shoe housing 3. The phase difference of the camshaft 2 against the crankshaft 1*a* is adjusted by controlling the fluid pressure applied to each fluid pressure chamber.

When the engine stops, the operating fluid is not supplied to the retarding-side fluid pressure chambers 10, 11, 12 and the advancing-side fluid pressure chambers 13, 14, 15 so that the vane rotor 9 stops at the most retarded position relative to the shoe housing 3 as shown in FIG. 2. As the operating fluid is not supplied to the fluid pressure chambers 37 and 38 either, the stopper piston 7 fits into the stopper hole 22 by the biasing force of the spring 8.

Even when the engine restarts, the stopper piston 7 is held fitted in the stopper hole 22 until the operating fluid is supplied to the retarding-side fluid pressure chambers 10, 11, 12 and the advancing-side fluid pressure chambers 13, 14, 15, and the camshaft 2 is maintained at the most retarded angular position against the crankshaft 1*a*. Thus, during the period before the operating fluid is supplied to each fluid pressure chamber, the vane rotor 9 is locked to the front plate 5 to prevent the shoe housing 3 and the vane rotor 9 from hitting each other because of changes in the torque of the cam.

Once the operating fluid is supplied to each retarding-side fluid pressure chamber or advancing-side fluid pressure chamber and then supplied to the fluid pressure chamber 37 or 38, the stopper piston 7, receiving force in the right direction in FIG. 1, moves out from the stopper hole 22 against the biasing force of the spring 8. As the front plate 5 and the vane rotor 9 is thus released from the locked condition, the vane rotor 9 is enabled to turn relatively against the shoe housing 3 in response to the pressure of operating fluid supplied to the retarding-side fluid pressure chambers 10, 11, 12 and the advancing-side fluid pressure chambers 13, 14, 15. Thus, the relative phase difference of the camshaft 2 against the crankshaft 1*a* is adjusted.

The machining of the housing is attained as follows.

Figure 3B:
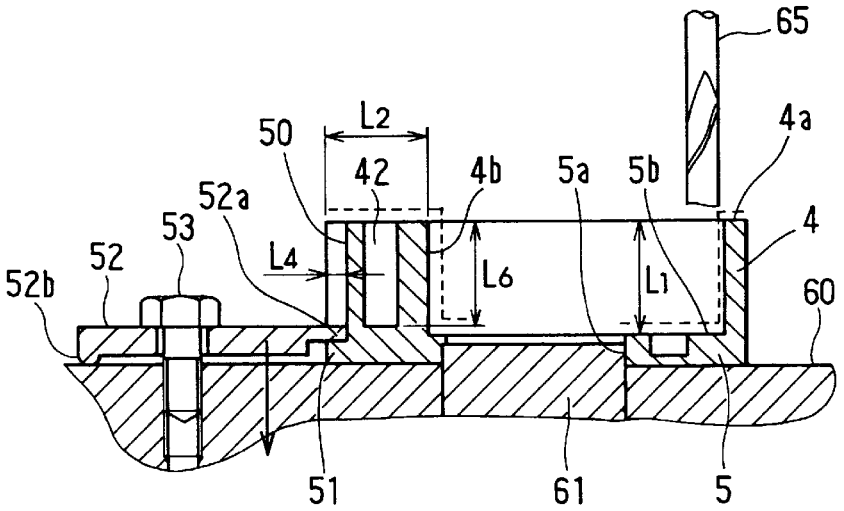

The shoe housing 3 is formed into a shape shown in FIGS. 3A and 3B by aluminum die-casting. A distortion-absorbing hole 42 as a deformation-absorbing hole is formed together with the shoe housing 3 by aluminum die-casting. The distortion-absorbing hole 42 formed between the inner circumferential surface of each shoe and the clamp seat 51 has a diameter $L_3$ of 5 mm and a depth $L_6$ of 22 mm respectively shown in FIGS. 4 and 3B.

The shoe housing 3 is placed and held on a base plate 60, and a fixing seat 61 is fitted into a bushing hole 5*a*. A claw 52*a* provided on one end portion of a draw claw 52 as a pressing member is latched to the clamp seat 51 of the shoe housing 3. A protrusion 52*b* is provided on another end portion of the draw claw 52. The clamp seat 51 is pressed onto the base plate 60 by the claw 52*a* by fastening a bolt 53 using the protrusion 52*b* as a pivot.

Figure 4:
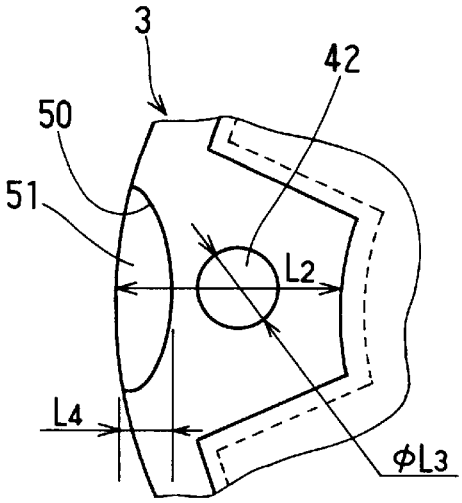
FIG. 4 is a schematic view of a shape of a shoe according to the first embodiment.
Figure 5:
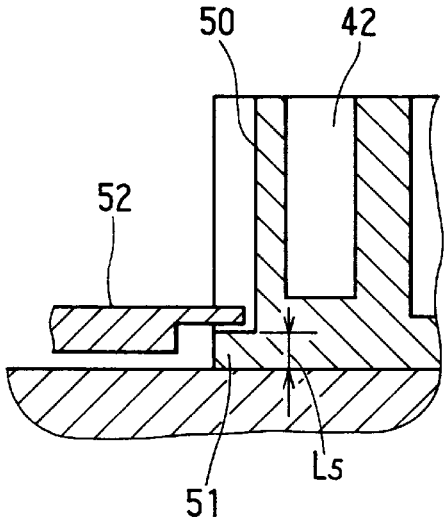
FIG. 5 is a schematic cross-sectional view showing a state when clamping a clamp seat according to the first embodiment.

After fixing the shoe housing 3 to the base plate 60, dotted-line portion of the shoe housing 3 shown in FIG. 3B and 4, that is, an opening end surface 4*a* of the circumferential wall 4, an inner circumferential surface of the circumferential wall 4 and an inside surface 5*b* of the front plate 5 are machined by an end mill 65. The dimensions of respective portions after machining by the end mill 65 are as follows; a depth $L_1$ of the shoe housing 3 is 22 mm, a radial thickness $L_2$ of each shoe is 20 mm, a length $L_4$ of the clamp seat 51 is 3 mm, and a thickness $L_5$ of the clamp seat 51 is 5 mm.

Figure 6:
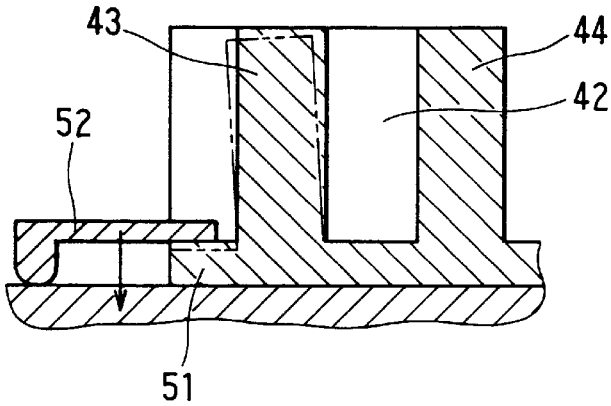
FIG. 6 is a schematic view showing deformation caused by clamping the clamp seat according to the first embodiment.

When the clamp seat 51 is pressed by the draw claw 52, the portion of each shoe which is on the outer circumferential side 43 of the distortion-absorbing hole 42 is resiliently deformed as shown with chain double-dashed lines in FIG. 6. On the other hand, the portion of each shoe on the inner circumferential side 44 of the distortion-absorbing hole 42 is rarely deformed.

When the draw claw 52 is removed after machining by the end mill 65, though the accuracy of the flatness of the opening end surface 4*a* of the outer circumferential side 43 and the squareness between the outer circumferential side 43 and the inside surface 5*b* is decreased, the opening end surface 4*a* of the shoe housing 3 except the outer circumferential side 43 of each shoe, the inner circumferential surface 4*b* of the shoe housing 3 including the inner circumferential surface of each shoe, and the inside surface 5*b* of the shoe housing 3 have high machining accuracy since they are not influenced by the deformation of the outer circumferential side 43 of each shoe, so that the sealability between the shoe housing 3 and the timing gear 1 and between the shoe housing 3 and the vane rotor 9 is improved, and scoring and uneven wear at the sliding portion between the shoe housing 3 and other members are reduced.

The distortion-absorbing hole 42 is tapped after cutting by the end mill 65 to form a female screw portion to be threaded with a male screw portion of the bolt 20.

In the above-described first embodiment, the clamp seat 51 is formed by providing the recess 50 at the outer circumferential side of each shoe without thickening the shoe housing 3 or enlarging the diameter of the shoe housing 3, so that the shoe housing 3 can be prevented from being increased in size.

Further, the first embodiment employs the construction wherein rotation driving force of the crankshaft is transmitted to the camshaft 2 through the timing gear 1, but it is possible to employ a construction wherein a timing pulley, a chain sprocket or the like is used.

Figure 7:
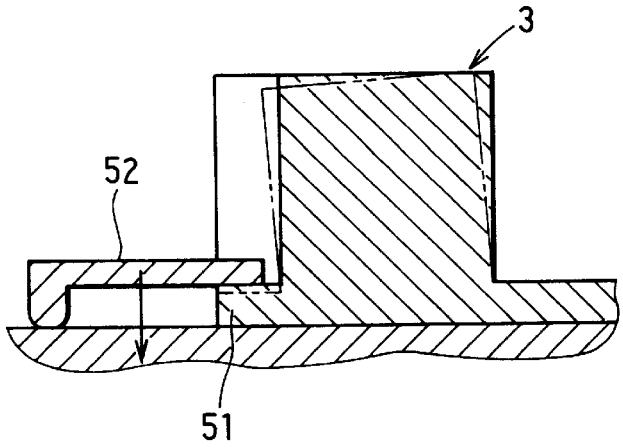
FIG. 7 is a schematic cross-sectional view showing a first modification of the first embodiment.

Further in the first embodiment, the distortion-absorbing hole 42 is provided to reduce the deformations of the shoe housing 3 when the clamp seat 51 is pressed by the draw claw 52. As in a first modification shown in FIG. 7, however, the deformations of the shoe housing 3 can be reduced by providing the clamp seat 51 in the outer circumferential surface of each shoe as a partition, not by providing a distortion-absorbing hole.

Figure 8:
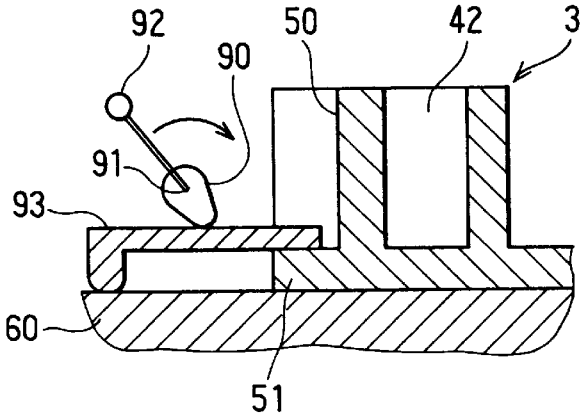
FIG. 8 is a schematic cross-sectional view showing a second modification of the first embodiment.

As in a second modification shown in FIG. 8, the clamp seat 51 may be pressed onto the base plate 60 by biasing a draw claw 93 as a pressing member by a cam 90. The clamp seat 51 is pressed onto the base plate 60 by the cam 90 by moving a lever 92 in the direction of an arrow centered on a supporting axis 91.

Figure 9:
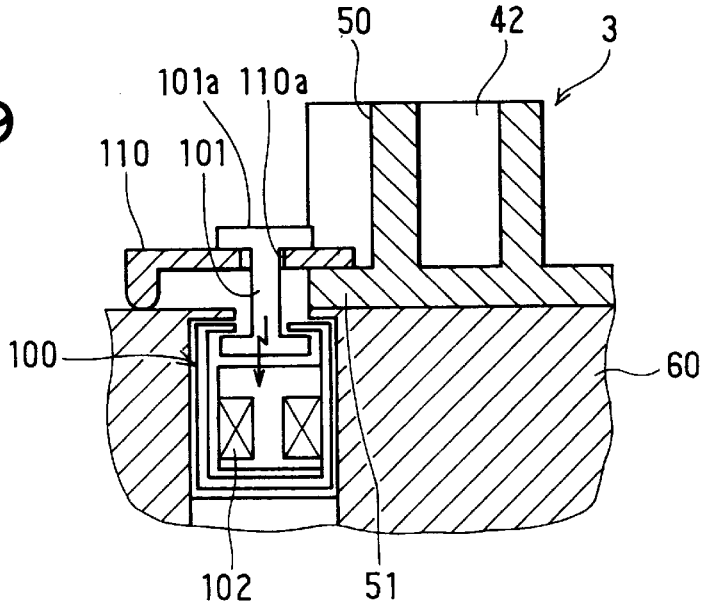
FIG. 9 is a schematic cross-sectional view showing a third modification of the first embodiment.

As in a third modification shown in FIG. 9, the clamp seat 51 may be pressed by using a magnetic driving apparatus 100. A fitting hole 110*a*, to which a moving rod 101 of the magnetic driving apparatus 100 can be fitted, is formed in a draw claw 110 as a pressing member. The moving rod 101 is attracted downwards in FIG. 9 by energizing a coil 102 of the magnetic driving apparatus 100, and a head portion 101*a* of the moving rod 101 pulls the draw claw 110. Thus, the clamp seat 51 is pressed onto the base plate 60.

Besides the second and the third modifications, the shoe housing 3 may be pressed by the draw claw 52 using pneumatic pressure or fluid pressure.

(Second Embodiment)

Figure 10:
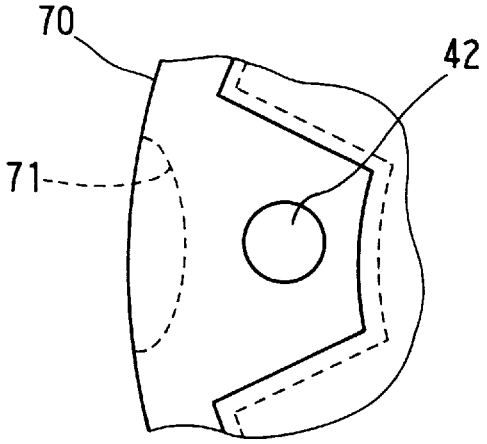
FIG. 10 is a schematic view of a shape of a shoe according to a second embodiment.
Figure 11:
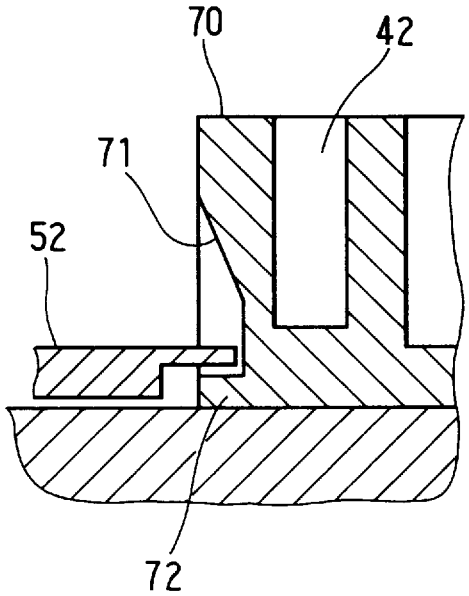
FIG. 11 is a schematic cross-sectional view showing a state when clamping a clamp seat according to the second embodiment.

As shown in FIGS. 10 and 11, a shoe housing 70 is formed by aluminum die-casting.

A recess 71 provided on the outer circumferential surface of each shoe is formed not to open to the opening side of the shoe housing 70. If the clamp seat 72 as a seat portion formed in the outer circumferential surface of each shoe by providing the recess 71 is pressed by the draw claw 52, the portion of the shoe on the inner circumferential side of the deformation-absorbing hole 42 is hardly deformed. Thus, the shoe housing 70 can be machined with high accuracy as well as in the first embodiment.

(Third Embodiment)

Figure 12:
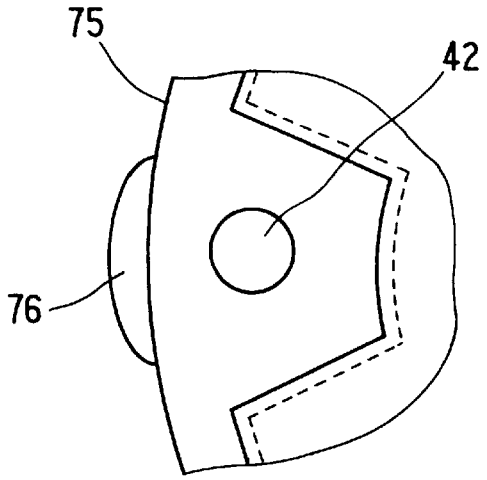
FIG. 12 is a schematic view of a shape of a shoe according to a third embodiment.
Figure 13:
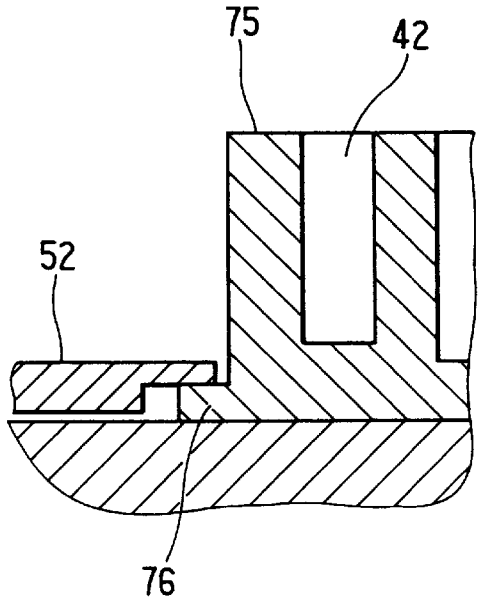
FIG. 13 is a schematic cross-sectional view showing a state when clamping a clamp seat according to the third embodiment.

As shown in FIGS. 12 and 13, a shoe housing 75 is formed by aluminum die-casting.

A clamp seat 76 as a seat portion provided on the outer periphery of each shoe protrudes from the outer circumferential wall of the shoe housing 75. If the clamp seat 76 is pressed by the draw claw 52, the portion of the shoe on the inner circumferential side of the deformation-absorbing hole 42 is hardly deformed. Thus, the shoe housing 75 can be machined with high accuracy as well as in the first embodiment.

In the above-described first to third embodiments of the present invention, a clamp seat is provided on the outer circumferential surface of each thick-walled shoe and a distortion-absorbing hole is also provided in the thick-walled shoe so that the portion of each shoe on the outer circumferential side of the distortion-absorbing hole is deformed mostly by clamping, and the deformation of the portion of each shoe on the inner circumferential side of the distortion-absorbing hole can be minimized. Thus, a shoe housing can be made of aluminum which is resiliently deformed easily without decreasing the stiffness. This allows the shoe housing to be machine-cut easily and reduces the shoe housing in weight.

The deformation-absorbing hole in each thick-walled shoe reduces the thickness of each shoe, and this removes an extreme thick-walled portion from the shoe housing. Thus, a shrinkage hole hardly occurs during forming the shoe housing by aluminum die-casting, thereby improving the quality of the wall of the shoe housing.

Other parts and apparatus, e.g., a rotor for crank angular sensor and a plate for preventing leakage from a journal, can be mounted in the shoe housing by forming a through hole or a screw hole in the clamp seat by utilizing the clamp seat of the draw claw after machining. Further in the first and the second embodiments, a nut for fastening a gear can be accommodated in a recess provided on the outer circumference of each shoe, thus saving the space in the engine.

The distortion-absorbing hole 42 is formed as a blind hole, but may be formed as a through hole.

(Fourth Embodiment)

Figure 14:
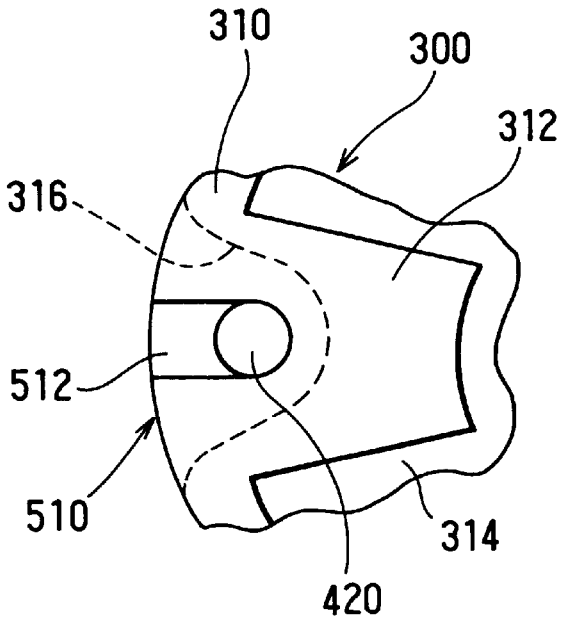
FIG. 14 is a plan view of a shape of a shoe according to a fourth embodiment of the present invention.
Figure 15:
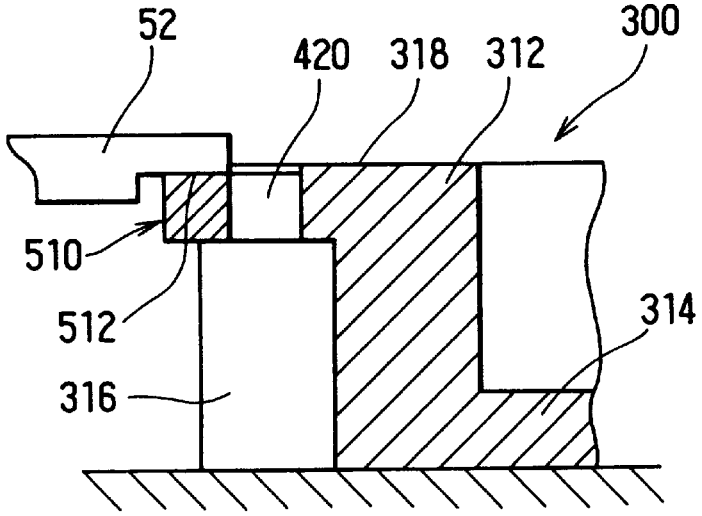
FIG. 15 is a schematic cross-sectional view showing a state when clamping a clamp seat according to the fourth embodiment.
Figure 16:
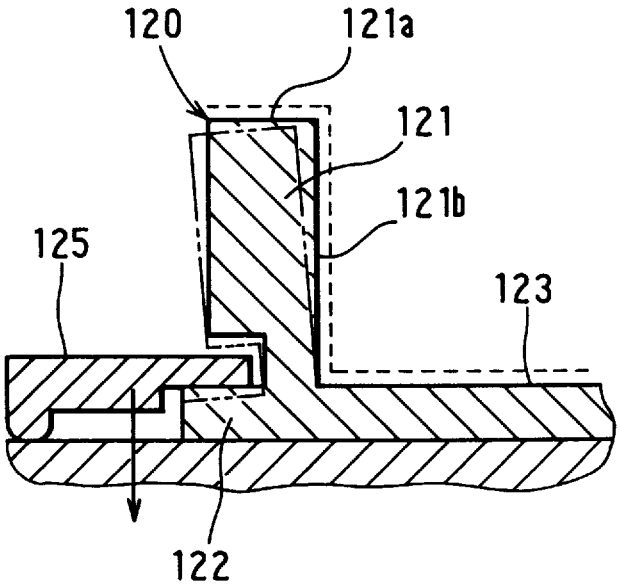
FIG. 16 PRIOR ART
FIG. 16 is a schematic cross-sectional view showing a construction of a conventional clamp seat.
Figure 17:
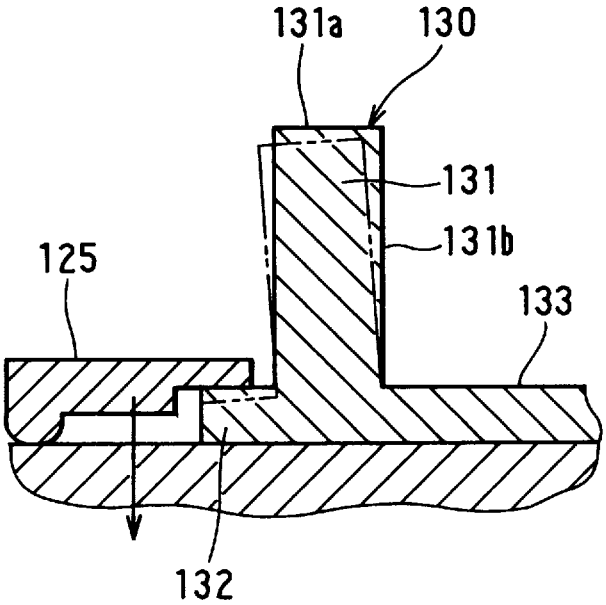
FIG. 17 PRIOR ART
FIG. 17 is a schematic cross-sectional view showing a construction of a conventional clamp seat.

As shown in FIGS. 14 and 15, a housing 300 is constructed to have a circumferential wall 310, a shoe 312 and a side wall 314. The circumferential wall 310 is formed concavely in a radially inward direction in part of the shoe 312 and has a concave wall surface 316. A flange portion 510 as a seat portion is formed in the housing 300, protruding in the form of a visor from a recess formed by the recess-shaped wall surface 316. The flange portion 510 is located corresponding to the opening end on one end side of the housing 300. An attachment hole 420, to which a bolt for fixing the other side wall (not shown) is attached, is formed in the flange portion 510. The attachment hole 420 functions as an absorbing hole. A seat surface 512 is formed in the housing 300, facing to one end side of the housing 300 and slightly concave in the end surface 318 on the one end side of the housing. When the housing 300 is machined, the draw claw 52 is made to contact with the seat surface 512 to axially push the housing to be fixed. According to this embodiment, the seat portion 510 is formed at a radially outer position of the shoe 312, thus preventing distortion at the time of fixing from influencing the inside of the housing 300. In addition, the plate-shaped flange portion 510 as a seat portion makes distortion difficult to be transferred. Further, since the seat surface 512 is located at a radially outer position of the attachment hole 420, the attachment hole 420 also prevents the distortion from transferring.

The shape of the seat portion 510 is not limited to the shape along the circular outer edge of the housing 300 shown in FIG. 14, but may be a shape extending outward radially only in the shoe.

A rotational phase adjusting apparatus of the present invention may be used for adjusting the rotational phase between any rotational shafts as well as for adjusting the valve timing of an engine.

What is claimed is:

1. A rotational phase adjusting apparatus for adjusting rotational phase between a driving shaft and a driven shaft, said apparatus comprising:

a housing disposed in a driving force transmitting system which transmits a driving force from the driving shaft to the driven shaft and which is rotatable with one of the driving shaft and the driven shaft, said housing having a circumferential wall integrally formed with one of side walls and having therein an accommodating chamber formed by at least one partition;

a vane rotatable with the other of the driving shaft and the driven shaft, said vane being accommodated in the accommodating chamber formed in the housing and rotatable relative to the housing in a predetermined angular range;

a driving means which makes the housing rotate relative to the vane by fluid pressure; and a seat portion which is provided radially outside of and aligned with an outer circumferential surface of said at least one partition and radially inside of an outer circumferential surface of the circumferential wall, and which is made to contact a pressing member which axially presses the housing while the associated partition of the housing is being machined.

2. A rotational phase adjusting apparatus as in claim 1, wherein the thickness of the seat portion is smaller than that of said side wall.

3. A rotational phase adjusting apparatus as in claim 1, wherein a deformation-absorbing hole is provided between an inner circumferential surface of a partition to be machined and the seat portion associated therewith.

4. A rotational phase adjusting apparatus as in claim 1, wherein the circumferential wall and said side wall are integrally formed by aluminum die-casting.

5. A rotational phase adjusting apparatus for adjusting rotational phase between a driving shaft and a driven shaft, said apparatus comprising:

a housing disposed in a driving force transmitting system which transmits a driving force from the driving shaft to the driven shaft, said housing having a circumferential wall, a partition protruding inwardly from the circumferential wall integrally therewith, and an accommodating chamber formed to extend circumferentially from the partition as an end portion;

a vane accommodated in the accommodating chamber rotatably relative to the housing; and a seat portion formed radially inside of an outer periphery of the circumferential wall of the housing at a radially outer position aligned with the partition and facing an axial direction of the housing.

6. A rotational phase adjusting apparatus as in claim 5, wherein:

an attachment hole for a bolt is formed in the partition, and the seat portion is located in a radially outer position of the attachment hole.

7. A rotational phase adjusting apparatus as in claim 5, wherein:

the seat portion is formed on one end side of the housing and facing to the other end side in the axial direction.

8. A rotational phase adjusting apparatus as in claim 7, wherein:

the housing has a side wall, integrally formed with the circumferential wall, on one end in the axial direction of the accommodating chamber, and the seat portion is formed in the end portion where the integrated side wall is formed.

9. A rotational phase adjusting apparatus as in claim 5, wherein:

the seat portion is formed on one end side of the housing and facing to the end side in the axial direction.

10. A rotational phase adjusting apparatus for adjusting a rotational phase between a driving shaft and a driven shaft, said apparatus comprising:

a housing rotatable with one of the shafts, the housing having a cylindrical wall and a side wall integrally formed with the cylindrical wall to close one axial side of the cylindrical wall, the cylindrical wall having shoes extending inwardly in a radial direction from a radially inner surface to define chambers, the cylindrical wall further having recesses formed at radially outside of the shoes and at radially inside of a radially outer surface to provide a flange within an outer periphery of the cylindrical wall; and vanes rotatable with the other of the shafts and accommodated movably in the chambers.

11. The rotational phase adjusting apparatus according to claim 10, wherein:

the flange is provided on the same plane as the side wall at the one axial side of the cylindrical wall.

12. The rotational phase adjusting apparatus according to claim 11, wherein:

the flange is thinner than the side wall in an axial direction of the cylindrical wall.

13. The rotational phase adjusting apparatus according to claim 11, wherein:

the flange has a hole at a position between the outer periphery of the cylindrical wall and an outer periphery of the shoes.

14. The rotational phase adjusting apparatus according to claim 10, wherein:

the flange is provided at the other axial side of the cylindrical wall.

15. The rotational phase adjusting apparatus according to claim 14, wherein:

the flange has a seat surface at an axially outer side, the seat surface being axially inside of an axial end surface of the one axial side of the cylindrical wall.

16. The rotational phase adjusting apparatus according to claim 14, wherein:

the flange has a hole between the outer periphery of the cylindrical wall and an outer periphery of the shoes.

17. A method for more accurately machining the cast housing of a rotational phase adjusting apparatus, said housing having plural shoe-partition members radially inwardly of a circumferential wall, said method comprising:

providing an axially-directed machining clamp seat on the housing opposite and radially outward of each said shoe-partition member; and clamping said housing onto a holding surface by applying axially-directed clamping forces against said clamp seat while machining surfaces on the cast housing.

18. A method as in claim 17 further comprising:

providing a deformation-absorbing hole in each shoe-partition member radially inward of its respectively associated machining clamp seat.

* * * * *